United States Patent [19]

Nagatsuna et al.

[11] Patent Number: 4,835,565

[45] Date of Patent: May 30, 1989

[54] IMAGE DEVELOPING DEVICE FOR ELECTROPHOTOGRAPHY

[75] Inventors: Shinzi Nagatsuna, Tokyo; Toshihiko Takaya, Yokohama; Kinzi Saito, Kawasaki; Hiroyuki Matsushiro; Michihito Ohashi, both of Yokohama, all of Japan

[73] Assignee: Ricoh Company, Ltd., Tokyo, Japan

[21] Appl. No.: 60,536

[22] Filed: Jun. 11, 1987

[30] Foreign Application Priority Data

Jun. 11, 1986 [JP] Japan ..... 61-133854
Jul. 16, 1986 [JP] Japan ..... 61-108875[U]

[51] Int. Cl.[4] ..... G03G 15/08
[52] U.S. Cl. ..... 355/259
[58] Field of Search ..... 355/3 DD, 14 D, 3 R, 355/15; 118/653, 249, 262

[56] References Cited

U.S. PATENT DOCUMENTS

| | | | |
|---|---|---|---|
| 3,931,792 | 1/1976 | Sato | 118/653 X |
| 4,103,652 | 8/1978 | Garside et al. | 123/377 X |
| 4,212,631 | 7/1980 | Franke et al. | 355/3 FU X |
| 4,469,435 | 9/1984 | Nosaki et al. | 355/3 DD X |
| 4,710,016 | 12/1987 | Waatanabe | 355/3 DD X |

FOREIGN PATENT DOCUMENTS

| | | | |
|---|---|---|---|
| 0005573 | 1/1981 | Japan | 355/3 DD |
| 0052065 | 3/1982 | Japan | 355/3 DD |
| 0076771 | 5/1985 | Japan | 355/3 DD |
| 0103367 | 6/1985 | Japan | 355/3 DD |

OTHER PUBLICATIONS

*IBM Technical Disclosure Bulletin*, vol. 19, No. 10, Mar. 1977, Abstract No. 57425 0012*d*, Williams, E. M., "Mechanically Compliant (Self-Adjusting) Developer Unit".

*Primary Examiner*—Arthur T. Grimley
*Assistant Examiner*—John G. Smith
*Attorney, Agent, or Firm*—Oblon, Fisher, Spivak, McClelland & Maier

[57] ABSTRACT

An electrophotographic image developing device includes a fixed rotatable member and a suspended rotatable member reciprocally movable toward and away from the fixed rotatable member. Rotative power from a drive source is transmitted to the suspended rotatable member through a power transmitting unit which includes a coupling capable of absorbing axial misalignment between driver and driven shafts.

1 Claim, 7 Drawing Sheets

IMAGE DEVELOPING DEVICE FOR ELECTROPHOTOGRAPHY

BACKGROUND OF THE INVENTION

1. Field of the Invention

The present invention relates to an image developing device for electrophotography, and more particularly to an electrophotographic image developing device having various members pressed against other members for developing latent images.

2. Description of the Background

Many electrophotographic image developing devices employing one-component developer (hereinafter referred to as "toner") now in use include various members pressed against other members for developing latent images.

For example, a contact-type image developing device has a toner carrier comprising a developing roller which is held under given pressure against the surface of a latent image carrier in the form of a photosensitive drum or the like for developing a latent image formed on the latent image carrier. In such an image developing device, a toner limiting member such as a thin-toner-layer forming roller is frequently disposed in pressed contact with the surface of the toner carrier for pressing new toner supplied onto the toner carrier into a thin toner layer of uniform thickness. Additionally, a toner supply member comprising a toner supply roller or the like is often positioned in pressed contact with the surface of the toner carrier for scraping remaining toner off the toner carrier after the image has been developed and also for supplying new toner onto the toner carrier.

The toner carrier, the toner supply member, and the toner limiting member are rotated by a rotation transmitting mechanism comprising drive gears directly fixed to the support shafts of these members and held in mesh with each other. In the rotation transmitting mechanism of this type, however, when the device members or components are rotated, driving force components act on the support shafts due to the pressure angles (which are normally about 20°) of the drive gears, and the pressure under which driver members are held against driven members is increased or reduced.

Therefore, the contact pressures between the device members are not uniform, causing the thickness of the thin toner layer transferred into an image developing area to become irregular. As a result, the toner density of a developed visible image is uneven, and the produced copy suffers from background contamination and low resolution. Particularly, contact failure of the members tends to cause a hollow area in a developed image and image density irregularities. Further, excessive contact pressures is apt to develop background contamination due to undesirable toner deposits, and jitter is caused by an increased load.

One solution to the above problems has been to simultaneously rotate the opposite ends of the support shaft of each of the device members. However, this arrangement requires a complex drive mechanism and results in an image developing device of larger size.

Where the toner carrier such as a developing roller and the thin-toner-layer forming member are made of a highly rigid material such as metal, synthetic resin, or the like, and such have fixed axes, these members are liable to be pressed against each other under varying pressures as they rotate because of their accuracy tolerances. As a result, the formed toner layer may be of uneven thickness and may be locally reduced in thickness. It has been proposed to eliminate these drawbacks by constructing the thin-toner-layer forming member as a resilient roll. However, the resilient roll still tends to undergo pressure variations during rotation thereof, making it difficult to stabilize the amount of charging of the toner. Since the resilient roll presents high frictional resistance, it cannot be adequately cleaned. It has also been proposed to plate the surface of the resilient roll with metal to reduce the coefficient of friction of the roll for thereby improving its cleanability. When the resilient roll is elastically deformed under pressure, however, the plated metal layer is liable to come off or be cracked. The metal-plated resilient roll is thus poor in durability.

In view of the aforesaid image developing devices using one-component developer, which has been used or proposed, the inventors have proposed an image developing device of the kind described above which includes a developing roller in the form of a resilient roll such as a silicone rubber roll in which carbon of a hardness ranging from 15° to 50°JISA is dispersed, or an NBR rubber roll with a urethane layer disposed on its peripheral surface, and a thin-toner-layer forming member of metal or synthetic resin which is supported so that its axis is movable with respect to the axis of the developing roller, the thin-toner-layer forming member being pressed under constant pressure against the developing roller by gravity and by a spring.

This arrangement has been successful in eliminating toner layer thickness irregularities and making uniform the amount of charging of the toner, thus making it possible to develop images adequately. This proposed image developing device can be employed for contact-type or noncontact-type image development, but is more advantageous when used for contact-type image development.

FIGS. 10 and 11 of the accompanying drawings illustrate an arrangement of such a contact-type image developing device. A thin-toner-layer forming member or roller 49 is rotatably supported by bearings 52 fitted in guides of a bearing guide member 51 with clearances around the bearings 52 in every direction. The bearings 52 are normally urged toward a developing roller 46 under the bias of springs (not shown). If the developing roller 46 and the thin-toner-layer forming member 49 have an accuracy error, the bearings 52 are moved in the respective guides of the bearing guide member 51 in various directions as indicated by the arrows (FIG. 10) in a plane normal to the axis of the member 49, so that the thin-toner-layer forming member 49 can be pressed against the developing roller 46 under constant pressure at all times.

As shown in FIGS. 12 and 13, the proposed image developing device 42 may be positioned differently with respect to a latent image carrier or photosensitive drum 41. The image developing device 42 may be used in combination with a latent image carrier such as a photosensitive belt 41' as shown in FIG. 14. Those parts in FIGS. 12, 13 and 14 which are identical to those in FIG. 10 are denoted by identical reference numerals.

In the image developing device 42 proposed by the inventors, a toner supply member 45 mechanically scrapes unused or remaining toner off the developing roller 46 and then supplies new toner by way of mechanical frictional transfer to the developing roller 46 as initialized. When the toner is frictionally supplied, it is triboelectrically charged and electrostatically attracted to the developing roller 46. In order to eliminate toner supply irregularities, however, the toner should be supplied more effectively and efficiently from the toner supply member 45 to the developing roller 46.

Particles having a diameter of about 10 micrometers, such as toner particles used as an image developer, can triboelectrically charged. It is known that when particles of idential diameters are triboelectrically charged, they are charged to different polarities. The toner particles charged to opposite polarity increase their charge distribution when an image is developed, thus obstructing uniformity of image development. The oppositely charged toner is responsible for contamination of the background of a copy.

SUMMARY OF THE INVENTION

It is an object of the present invention to provide an image developing device in which undesired forces that would be caused by axial misalignment between driver and driven shafts during transmission of rotative power to a suspended rotatable member are eliminated to allow the suspended rotatable member to be driven in good contact with a fixed rotatable member, which has a relatively simple and small driving mechanism, and which can form a developer into a uniform thin layer in its entirety as it is fed into an image developing area, for producing copies of good quality.

Another object of the present invention is to provide an image developing device in which toner can highly effectively and efficiently be supplied from a toner supply member to a developing roller to reduce toner supply irregularities, and which can produce images of reduced background contamination.

According to the present invention, there is provided an image developing device for electrophotography, comprising a housing, a rotative drive source disposed in the housing and having an output shaft, a fixed rotatable member rotatably supported in the housing and fixed with respect to the housing, a suspended rotatable member rotatably supported in the housing and reciprocally movable toward and away from the fixed rotatable member, the suspended rotatable member having a driven shaft, urging means for pressing the suspended rotatable member against the fixed rotatable member, and rotation transmitting means for coupling the output shaft of the rotative drive source to the driven shaft of the suspended rotatable member and transmitting rotation from the output shaft to the driven shaft, the rotation transmitting means including coupling means for absorbing axial misalignment between the output shaft and the driven shaft.

According to the present invention, there is also provided an image developing device for electrophotography, comprising a latent image carrier for carrying a latent image, a developing roller rotatably held against the latent image carrier, a developer hopper for storing a one-component nonmagnetic developer, an agitator for agitating the developer in the developer hopper, a developer supply member for supplying the developer agitated by the agitator to the developing roller, a thin-layer forming member pressed against the developing roller for forming the developed supplied to the developing roller into a thin uniform layer, scraper means for scraping the developer off the thin-layer forming member into the developer hopper, the developing roller comprising a resilient roller, the thin-layer forming member being resiliently pressed against the developing roller under a constant pressure and having an axis movable perpendicularly to the axis of the developing roller, and means for applying DC voltages of $V_R$, $V_{SP}$, and $V_{R/R}$ to the developing roller, the developer supply member, and the thin-layer forming member, respectively, the voltage of $V_{SP}$ and $V_{R/R}$ being more positive than the voltage of $V_R$.

The above and other objects, features and advantages of the present invention will become more apparent from the following description when taken in conjunction with the accompanying drawings in which preferred embodiments of the present invention are shown by way of illustrative example.

Figure 1:
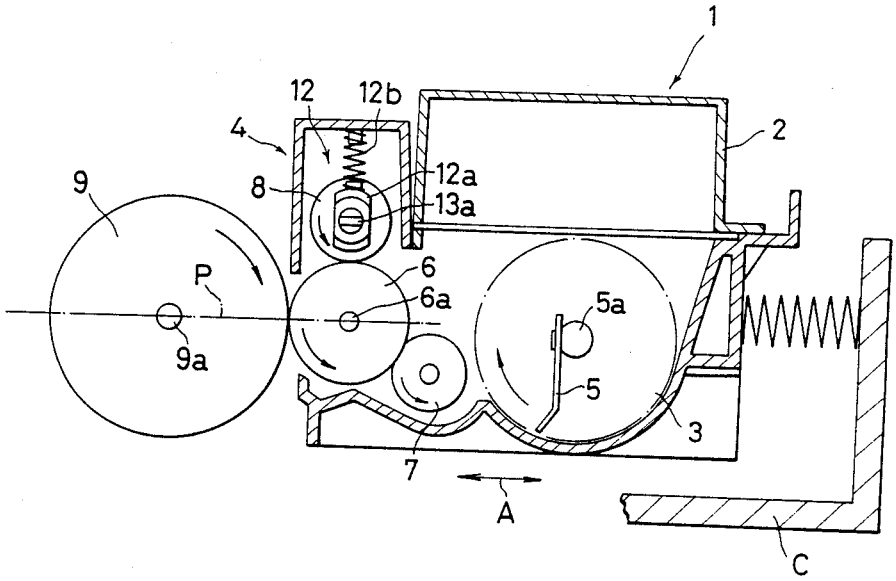
FIG. 1 is a vertical cross-sectional view of an image developing device employing one-component developer according to an embodiment of the present invention.

DESCRIPTION OF THE PREFERRED EMBODIMENTS as shown in FIG. 1, an image developing device, generally designated by the reference numeral 1, according to the present invention is disposed adjacent to a latent image carrier 9 in the form of a photosensitive drum 9. The image developing device 1 includes a case C housing therein an image developing unit 4 movable horizontally in the direction of the arrow A toward and away from the photosensitive drum 9. The image developing unit 4 includes therein a developer or toner carrier 6 comprising a developing roller rotatably held against the peripheral surface of the photosensitive drum 9, a developer or toner supply member 7 in the form of a toner supply roller, and a toner limiting member 8 in the form of a thin-toner-layer forming roller for pressing supplied toner into a thin toner layer on the developing roller 6. An agitator 5 is rotatably disposed behind the toner supply roller 7 for agitating and feeding a one-component nonmagnetic developer or toner which is stored in a toner hopper 2.

Figure 2:
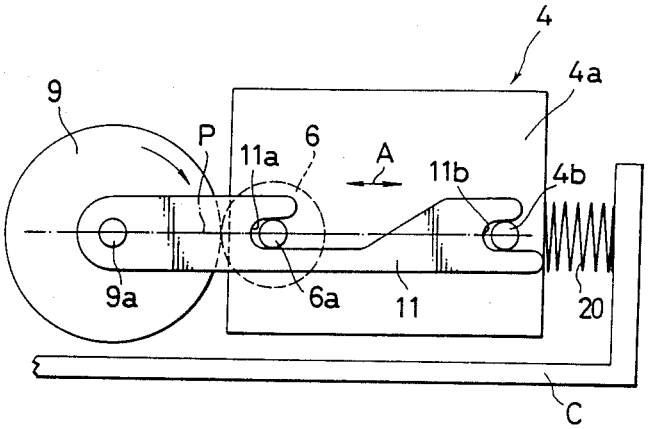
FIG. 2 is a side elevational view of a structure for holding an image developing unit in the image developing device shown in FIG. 1.

As shown in FIG. 2, the image developing unit 4 is held in place by a positioning member 11 which comprises a strip-like plate fixed to a main device frame or the case C. The positioning member 11 has portions thereof loosely fitted over shafts of the image developing unit 4, i.e., the shaft 6*a* of the developing roller 6 and a reference shaft 4*b* projecting from a side panel 4*a* of the image developing unit 4, for relative reciprocating movement. Therefore, the image developing unit 4 is bodily hung on the positioning member 11 and reciprocally movable with respect thereto.

The positioning member 11 has a front end (i.e. the lefthand end in FIG. 2) in which the shaft 9*a* of the photosensitive drum 9 is rotatably fitted. The positioning member 11 also has horizontal slots 11*a*, 11*b* defined in its central and rear end (i.e. the righthand end in FIG. 2) portions, respectively. The shafts 6*a*, 4*b* are loosely fitted in the horizontal slots 11*a*, 11*b*, respectively, for relative reciprocating movement in the horizontal direction indicated by the arrow A and also for rotation about their own axes.

The shaft 9*a* of the photosensitive drum 9, the shaft 6*a* of the developing roller 6, and the reference shaft 4*b* are held in substantial alignment with each other in the horizontal direction. The image developing unit 4 is supported on the positioning member 11 for horizontal movement toward and away from the photosensitive drum 9 as indicated by the arrow A. More specifically, the shaft 6*a* of the developing roller 6 is positioned by the positioning member 11 in a plane P in which the shaft 9*a* of the photosensitive drum 9 also lies, the plane P being substantially parallel to the direction A in which the image developing unit 4 is movable back and forth.

The slot 11*a* has its rear portion opening upwardly for a certain length, and the slot 11*b* has its rear portion opening upwardly and rearwardly. Therefore, the image developing unit 4 can be removed upwardly from engagement with the positioning member 11 by slightly moving the image developing unit 4 backwards (i.e. to the right in FIG. 2).

A compression spring 20 is disposed under compression between the rear side wall of the image developing unit 4 and a vertical side wall of the case C for normally urging the image developing unit 4 toward the photosensitive drum 9. As a result, the developing roller 6 is held against the peripheral surface of the photosensitive drum 9 under a prescribed pressure. The point where the developing roller 6 is pressed against the photosensitive drum 9 lies in the plane P.

With the above arrangement, the developing roller 6 is held in position directly by the positioning member 11. Therefore, parallelism between the developing roller 6 and the photosensitive drum 9 can easily and reliably be obtained. The shaft 6*a*, or the center of rotation, of the developing roller 6 is held for movement toward and away from the shaft 9*a*, or the center of rotation, of the photosensitive drum 9. The developing roller 6 is not positioned obliquely upwardly of the photosensitive drum 9 in contact therewith, as is the case with conventional image developing devices. Therefore, even when the developing roller 6 is somewhat lifted, the condition in which the developing roller 6 and the photosensitive drum 9 are held in contact with each other does not vary greatly. The developing roller 6 thus remains in contact with the photosensitive drum 9 with a greater degree of flexibility, i.e., even if the developing roller 6 is subjected to positional variations.

In the above embodiment, the shaft 6*a* itself of the developing roller 6 is held by the positioning member 11. However, the developing roller 6 may instead be supported in the vicinity of the shaft 6*a*.

As described above, the shaft 6*a* of the developing roller 6 is supported by the positioning member 11 which keeps the plane P containing the shafts 6*a*, 9*a* substantially parallel to the direction A in which the image developing unit 4 is movable back and forth. Consequently, the developing roller 6 can be held against the peripheral surface of the photosensitive drum 9 under appropriate and uniform pressure, thus preventing hollow image areas and image density variations which would otherwise arise from contact failure, and also preventing both background contamination which would otherwise be caused by excessive contact pressure and jitter which would otherwise result from a load increase.

Referring back to FIG. 1, the agitator 5 is fixed to a shaft 5*a* rotatably supported in the image developing unit 4. The agitator 5 is slowly rotated in the direction of the arrow (clockwise) by the shaft 5*a* which is driven by a drive source (not shown). The agitator 5 thus rotated agitates toner in a toner container 3 to push the toner toward the toner supply roller 7 while preventing toner blocking.

The toner supply roller 7 is made of a resilient material such as polyurethane foam or the like, and is rotatably supported in the image developing unit 4. The toner supply roller 7 is pressed into the peripheral surface of the developing roller 6 and rotated by a drive source (not shown) in the same direction as that in which the developing roller 6 rotates, so that the contacting surfaces of the toner supply roller 7 and the developing roller 6 move in opposite directions in frictional enagement with each other. The toner supply roller 7 as it rotates scrapes remaining toner off the peripheral surface of the developed roller 6 after having developing an image on the photosensitive drum 9, and at the same time supplies new toner to the peripheral surface of the developing roller 6.

Figure 4:
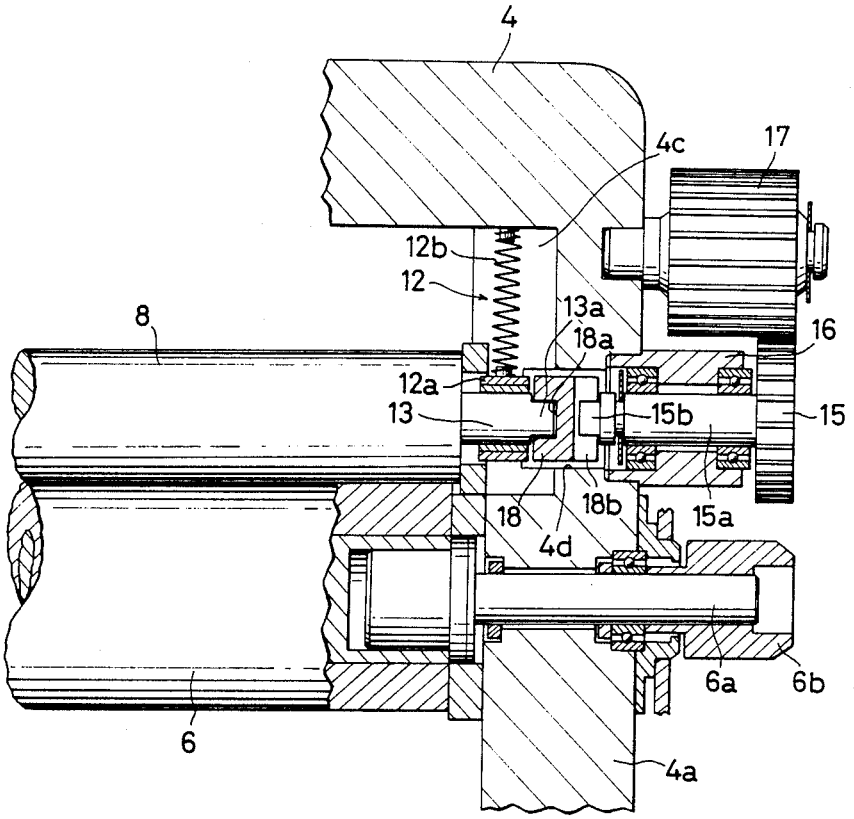
FIG. 4 is an enlarged fragmentary vertical cross-sectional view of the driving system shown in FIG. 3.

As illustrated in FIGS. 2 and 4, the shaft 6*a* fixed to each axial end of the developing roller 6 is rotatably supported on the side panel 4*a* of the image developing unit 4, so that the developing roller 6 is rotatably disposed in the image developing unit 4. A coupling 6*b* mounted on one of the axially opposite shafts 6*a* of the developing roller 6 is driven by a rotative drive source (not shown) to rotate the developing roller 6 counterclockwise in the direction of the arrow (FIG. 1). New toner supplied to the peripheral surface of the developing roller 6 is pressed by the thin-toner-layer forming roller 8 into a thin toner layer of uniform thickness, which is thereafter brought into contact with the photosensitive drum 9 rotating in contact with the developing roller 6 for developing an electrostatic latent image on the photosensitive drum 9 into a visible toner image.

Figure 3:
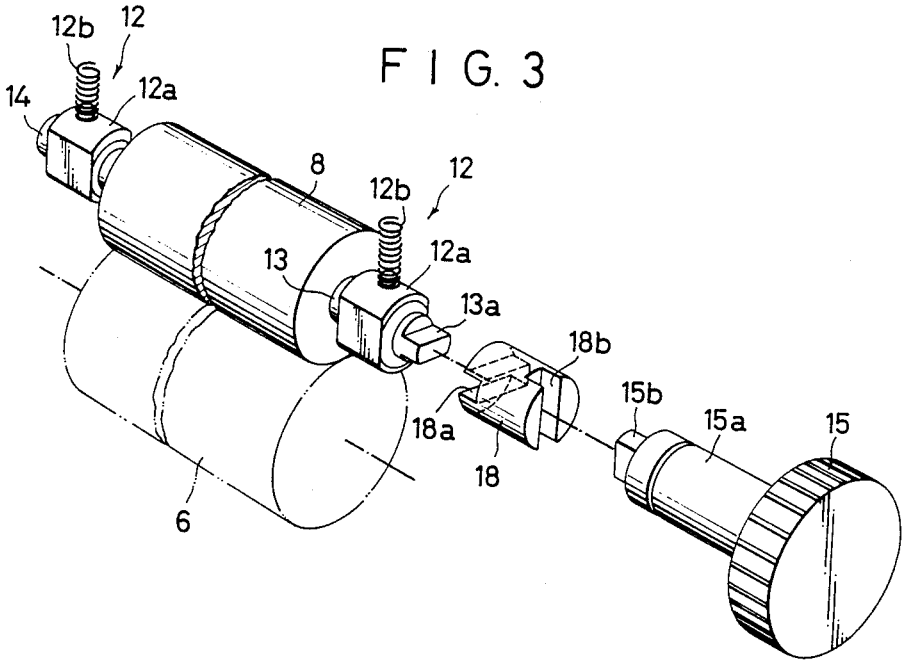
FIG. 3 is an exploded perspective view of a system for driving a thin-toner-layer forming roller in the image developing device.

As shown in FIGS. 1, 3 and 4, the thin-toner-layer forming roller 8 is resiliently pressed at its peripheral surface against the peripheral surface of the developing roller 6 under the weight of the layer forming roller 8 and a prescribed pressure by roller pressing means 12 at the respective ends of the roller 8. The roller pressing means 12 comprise bearings 12*a* by which support shafts 13, 14 projecting at the opposite ends of the roller 8 are rotatably supported, and compression coil springs 12*b* mounted under compression between the bearings 12*a* and the housing of the image developing unit 4. Each of the bearings 12*a* has parallel opposite sides placed slidably in a vertical slot 4*c* defined in the side panel 4*a*. The thin-toner-layer forming roller 8 is thus reciprocally movably supported in the image developing unit 4 for movement toward and away from the developing roller 6. The coil springs 12*b* press the bearings 12*a* and the support shafts 13, 14 to force the peripheral surface of the thin-toner-layer forming roller 8 resiliently against the peripheral surface of the developing roller 6.

The thin-toner-layer forming roller 8 is driven by a drive gear 15 to rotate in the direction of the arrow (counterclockwise) in FIG. 1, the drive gear 15 being disposed separately from the support shaft 13 which is driven. The drive gear 15 has an integral driver shaft 15*a* coaxial therewith and rotatably supported in a driver gear support 16 in the form of a hollow cylinder mounted on the side panel 4*a*. The driver gear support 16 is positioned such that a flat projection 15*b* on the distal end of the driver shaft 15*a* axially faces a flat projection 13*a* on the distal end of the driven shaft 13, and the center of rotation of the shaft 13 is axially aligned with the center of rotation of the driver shaft 15*a*.

The drive gear 15 is rotated by a drive source (not shown) through an idler gear 17 rotatably mounted on the side panel 4*a*. Rotative power from the drive gear 15 is transmitted to the support shaft 13 via a coupling 18 which is disposed between the shafts 13, 15*a* for absorbing axial misalignment therebetween.

The coupling 18 comprises an Oldham coupling having, as shown in FIG. 3, a first diametrical slot 18*a* at one end having a width such that the projection 13*a* of the support shaft 13 is fitted in the slot 18*a*, and a second diametrical slot 18*b* at the opposite end having a width such that the projection 15*b* of the driver shaft 15*a* is fitted in the slot 18*b*, the slots 18*a*, 18*b* extending perpendicularly to each other. As shown in FIG. 4, the coupling 18 is disposed in a hole 4*d* defined in the side panel 4*a* with the first slot 18*a* being fitted over the driven projection 13*a* and the second slot 18*b* being fitted over the driver projection 13*b*, while the drive gear 15 is being supported on the drive gear support 16. Since the first and second slots 18*a*, 18*b* are directed perpendicularly to each other, as shown in FIG. 3, the projections 13*a*, 15*b* interfere with the coupling 18 as it tends to be dismounted from the projections 13*a*, 15. Therefore, the coupling 18 is prevented from being dislodged from the projections 13*a*, 15 even if it is not disposed in the hole 4*d*.

Alternatively, the coupling 18 may have projections on its opposite axial ends and the shafts 13, 15*a* may have slots in which the projections of the coupling 18 may be fitted for transmitting rotative power from the drive gear 15 to the support shaft 13.

In the illustrated embodiment, however, the projections 13*a*, 15 can easily be formed by milling, and the slots 18*a*, 18*b* can easily be formed by molding the coupling 18 of plastics. Thus, the cost of manufacture is lower.

Rotative power from the drive source is transmitted through the coupling 18 to the thin-toner-layer forming roller 8 which is suspended for movement toward and away from the developing roller 6 that is fixedly positioned with respect to the image developing unit 4, while an image is being developed on the photosensitive drum 9. Inasmuch as the coupling 18 is in the form of an Oldham coupling, any undesired radial force which would otherwise be caused by axial misalignment of the shafts 13, 15*a* is not produced during transmission of rotative power from the driver shaft 15*a* to the driven shaft 13. Accordingly, the rollers 6, 8 are not subjected to undesired irregular forces tending to move them toward and away from each other, but remain pressed against each other only under the resilient force from the coil springs 12*b*. The rollers 6, 8 are therefore driven while being kept in appropriate contact with each other at all times.

Figure 5:
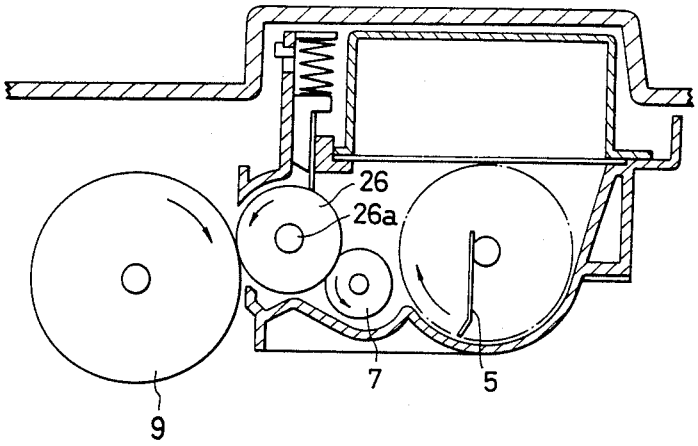
FIG. 5 is a vertical cross-sectional view of an image developing device employing one-component developer according to another embodiment of the present invention.
Figure 6:
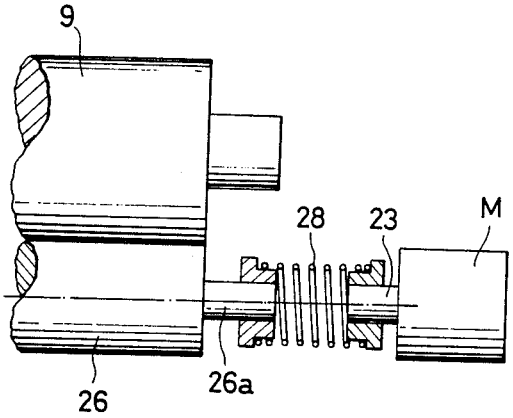
FIG. 6 is a front elevational view of a system for driving a developing roller in the image developing device illustrated in FIG. 5.
Figure 7:
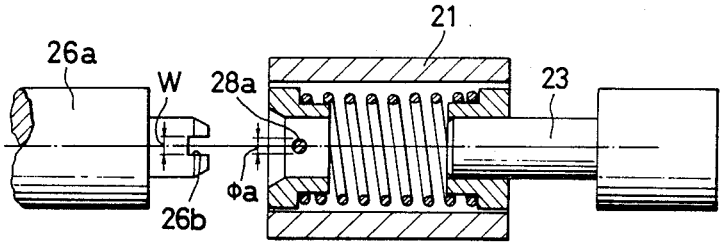
FIG. 7 is an enlarged fragmentary vertical cross-sectional view of the driving system shown in FIG. 6.

FIGS. 5 through 7 show an image developing device according to another embodiment of the present invention. As shown in FIG. 5, the peripheral surface of a developing roller 26 is resiliently pressed against the peripheral surface of the photosensitive drum 9 under a prescribed pressure. A bearing at each axial end of the developing roller 26 has flat opposite sides slidably mounted in a slot defined in a side panel of an image developing unit. The developing roller 26 is thus reciprocally movably supported for movement toward and away from the photosensitive drum 9. A compression coil spring is pressed against each of the bearings of the developing roller 26 so as to cause the bearings and support shafts to press the peripheral surface of the developing roller 26 resiliently against the peripheral surface of the photosensitive drum 9.

As shown in FIGS. 6 and 7, the developing roller 26 can be rotated counterclockwise in the direction of the arrow (FIG. 5) by a driver shaft 23 disposed separately from the support shaft 26*a* of the developing roller 26. The driver shaft 23 and the support shaft 26*a* are interconnected by a coupling 28.

The coupling 28 comprises a coil spring coupling having a diametrical pin 28*a* at one axial end thereof which is fitted in a slot 26*b* defined in the distal end of the support shaft 26*b*. The support shaft 26*a* can easily be disconnected from and connected to the coupling 28 when the image developing unit is replaced in its entirety as for changing toner colors.

It is preferable for the pin 28*a* to be fitted in the slot 26*b* without backlash therebetween for eliminating possible vibration. It has been found that good transmission of rotation from the driver shaft 23 to the support shaft 26*a* through the coupling 28 can be achieved if the width W (mm) of the slot 26*b* and the diameter a (mm) of the pin 28*a* meet the following formula:

$W-a \leqq 0.1$ (mm). The coupling 28 is circumferentially surrounded by a tubular coupling guide 21 (FIG. 7) so as to allow easy and smooth axial alignment and fitting.

In the embodiment of FIGS. 5 through 7, rotative power from the drive source is transmitted through the coupling 28 to the developing roller 26 which is floatingly disposed for reciprocating movement toward and away from the photosensitive drum 9 which is positionally fixed with respect to the image developing unit, while an image is being developed on the photosensitive drum 9.

The coupling 28 may be replaced with an Oldham coupling or other universal joint.

Figure 8:
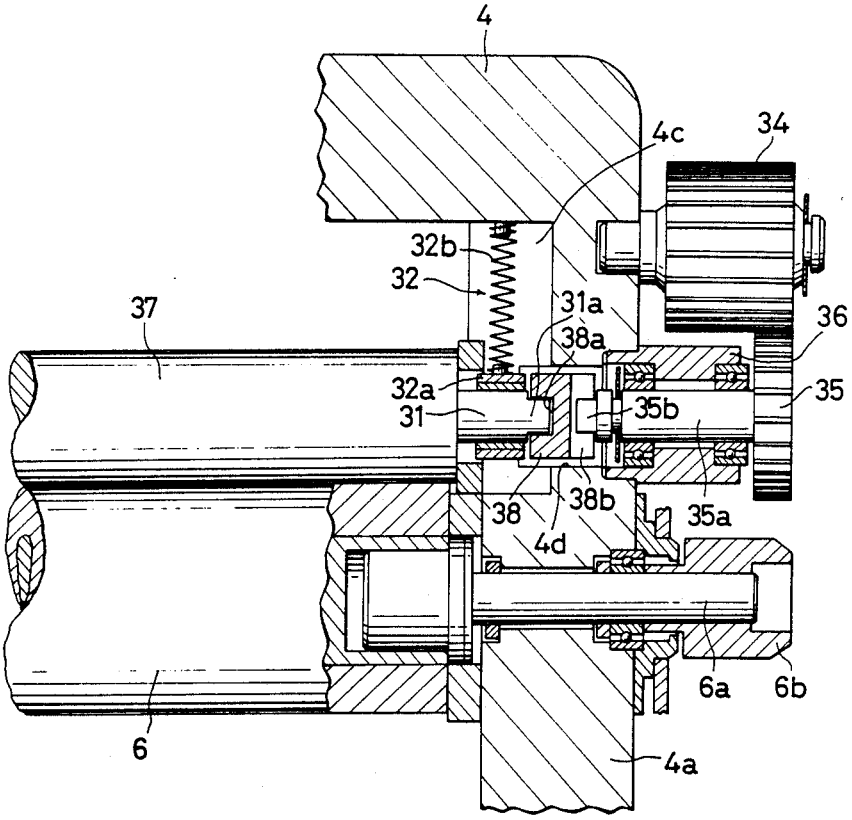
FIG. 8 is an enlarged fragmentary vertical cross-sectional view of a system for driving a toner supply roller according to still another embodiment of the present invention.

According to still another embodiment shown in FIG. 8, a toner supply roller 37 is resiliently pressed at its peripheral surface against the peripheral surface of the developing roller 6 under a prescribed pressure by roller pressing means 32 at the respective ends of the roller 37.

Each of the roller pressing means 32 comprises a bearing 32*a* by which a support shaft 31 projecting at one end of the roller 37 is rotatably supported, and a compression coil spring 32*b* mounted under compression between the bearing 12*a* and the housing of the image developing unit 4. The bearing 32*a* has parallel opposite sides placed slidably in the vertical slot 4*c* defined in the side panel 4*a*. The toner supply roller 37 is thus reciprocally movably supported in the image developing unit 4 for movement toward and away from the developing roller 6. The coil spring 32*b* presses the bearing 12*a* and the support shaft 31 to force the peripheral surface of the toner supply roller 37 resiliently against the peripheral surface of the developing roller 6.

The toner supply roller 37 is driven by a drive gear 35 disposed separately from the support shaft 31 which is driven. The drive gear 35 has an integral driver shaft 35*a* coaxial therewith and rotatably supported in a driver gear support 36 in the form of a hollow cylinder mounted on the side panel 4*a*. The driver gear support 36 is positioned such that a flat projection 35*b* on the distal end of the driver shaft 35*a* axially faces a flat projection 31*a* on the distal end of the driven shaft 31, and the center of rotation of the shaft 31 is axially aligned with the center of rotation of the driver shaft 35*a*.

The drive gear 35 is rotated by a drive source (not shown) through an idler gear 37 rotatably mounted on the side panel 4*a*. Rotative power from the drive gear 35 is transmitted to the support shaft 31 via a coupling 38 which is disposed between the shafts 31, 35*a* for absorbing axial misalignment therebetween.

The coupling 38 comprises an Oldham coupling having a first diametrical slot 38*a* at one end having such a width that the projection 31*a* of the support shaft 31 is fitted in the slot 38*a*, and a second diametrical slot 38*b* at the opposite end having such a width that the projection 35*b* of the driver shaft 35*a* is fitted in the slot 38*b*, the slots 38*a*, 38*b* extending perpendicularly to each other. The coupling 38 is disposed in the hole 4*d* defined in the side panel 4*a* with the first slot 38*a* being fitted over the driven projection 31*a* and the second slot 38*b* being fitted over the driver projection 31*b*, while the drive gear 35 is being supported on the drive gear support 36. Since the first and second slots 38*a*, 38*b* are directed perpendicularly to each other, the projections 31*a*, 35*b* interfere with the coupling 38 insofar as it tends to be dismounted from the projections 31*a*, 35. Therefore, the coupling 38 is prevented from being dislodged from the projections 31*a*, 35 even if it is not disposed in the hole 4*d*.

Alternatively, the coupling 38 may have projections extending from its opposite axial ends and the shafts 31, 35*a* may have slots in which the projections of the coupling 38 may be fitted for transmitting rotative power from the drive gear 35 to the support shaft 31. In the illustrated embodiment, however, the projections 31*a*, 35 can easily be formed by milling, and the slots 38*a*, 38*b* can easily be formed by molding the coupling 38 of plastics. Thus, the cost of manufacture is lower.

Rotative power from the drive source is transmitted through the coupling 38 to the toner supply roller 37 which is floatingly disposed for movement toward and away from the developing roller 6 that is fixedly positioned with respect to the image developing unit 4, while an image is being developed on the photosensitive drum 9. Inasmuch as the coupling 38 is in the form of an Oldham coupling, any undsired radial force which would otherwise be caused by axial misalignment of the shafts 31, 35*a* is not produced during transmission of rotative power from the driver shaft 35*a* to the driven shaft 31. Accordingly, the rollers 6, 37 are not subjected to undesired irregular forces tending to move them toward and away from each other, but remain pressed against each other only under the resilient force from the coil springs 32*b*. The rollers 6, 37 are therefore driven while being kept in appropriate contact with each other at all times.

Figure 9:
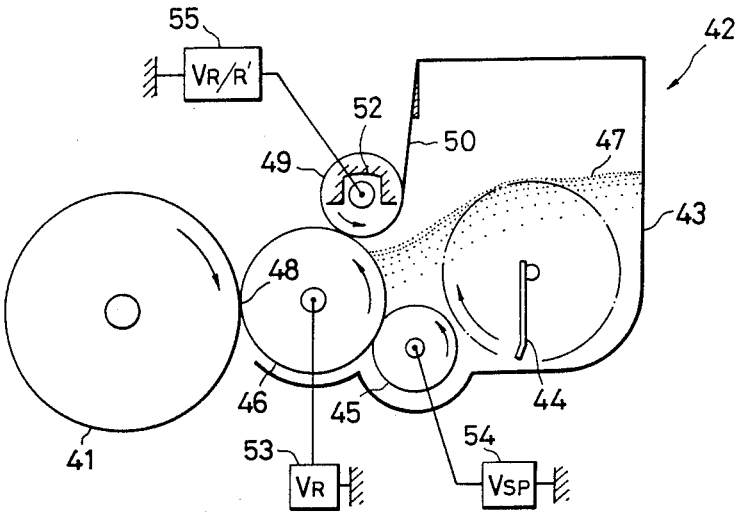
FIG. 9 is a schematic vertical cross-sectional view of an image developing device according to a further embodiment of the present invention.
Figure 10:
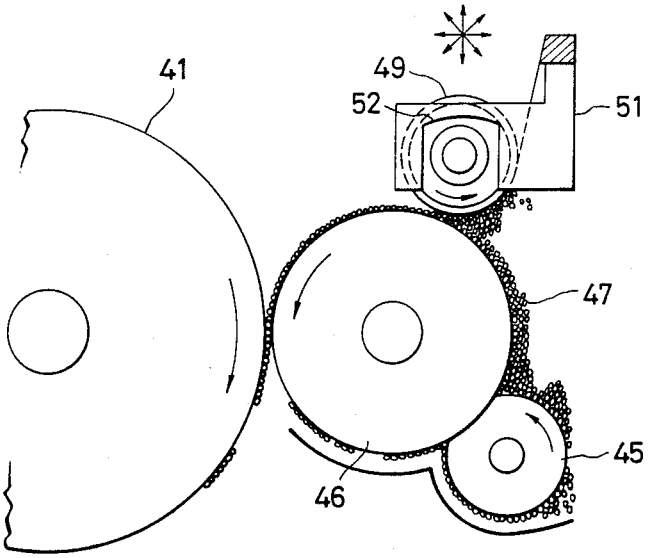
FIG. 10 is a vertical cross-sectional view of an image developing device proposed by the inventors.
Figure 11:
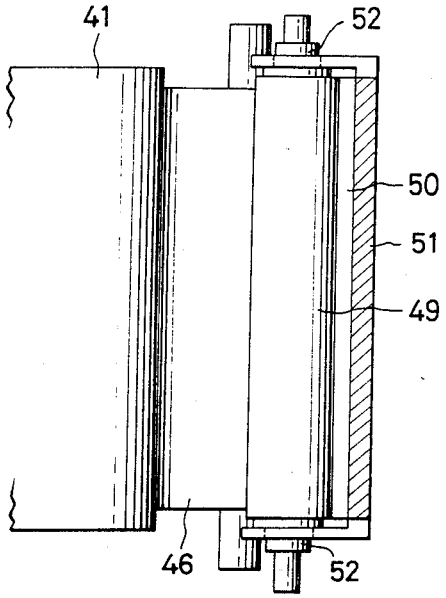
FIG. 11 is a plan view of the image developing device shown in FIG. 10.
Figure 12:
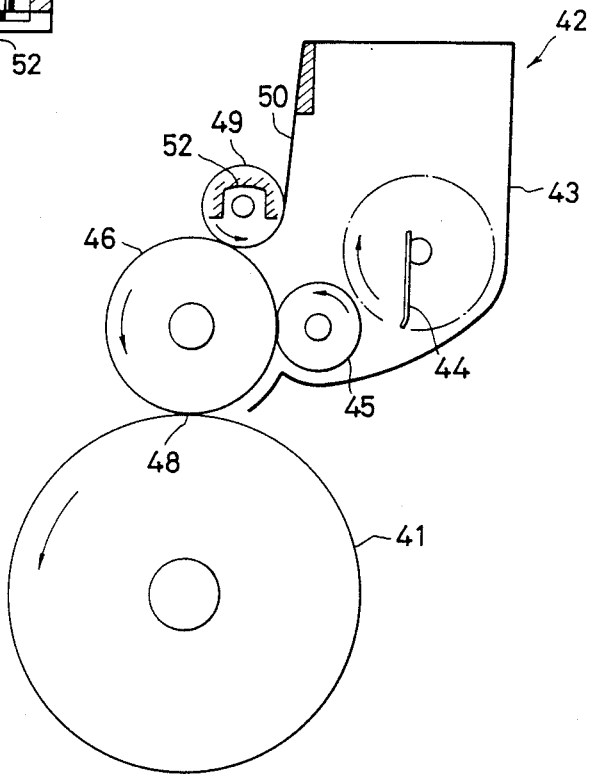
FIGS. 12 through 14 are vertical cross-sectional views of modified image developing devices proposed by the inventors.
Figure 13:
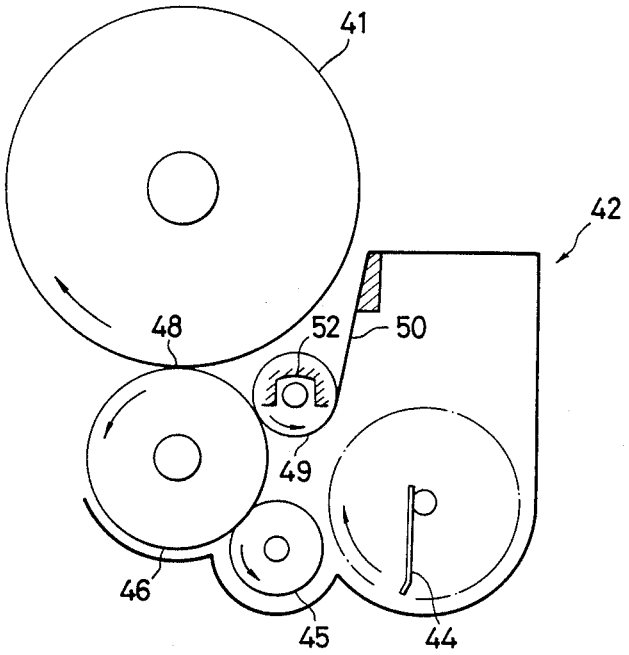
Figure 14:
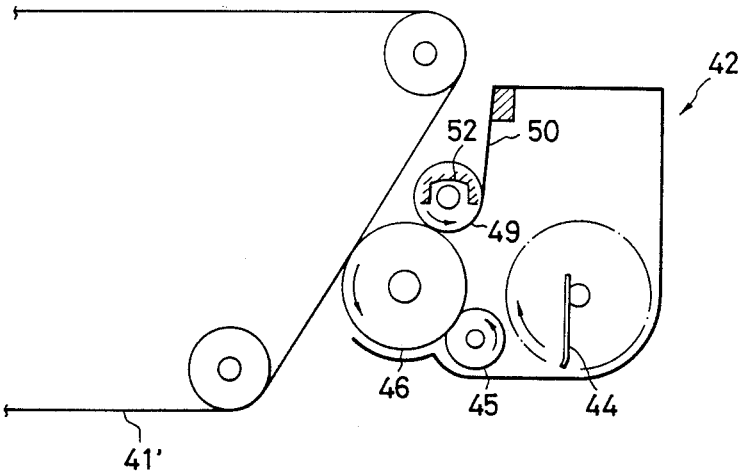

FIG. 9 shows an image developing device constructed in accordance with a further embodiment of the present invention. A DC voltage of $V_R$ is applied by a power supply 53 to a developing roller 46, a DC voltage of $V_{SP}$ is applied by a power supply 54 to a toner supply member 45, and a DC voltage of $V_{R/R'}$ is applied by a power supply 55 to a thin-toner-layer forming member 49. Irrespective of whether a normal or reversed image is developed, the voltages of $V_{SP}$, $V_{R/R}$ are selected to be more positive than the voltage of $V_R$.

The voltages $V_{SP}$, $V_{R/R}$ are selected with respect to the voltage $V_R$ such that they will produce an electric field which forces the toner toward the developing roller. More specifically, where the toner is of positive polarity, the voltages $V_{SP}$, $V_{R/R}$ are selected to be higher than the voltage $V_R$, and where the toner is of negative polarity, the voltages $V_{SP}$, $V_{R/R}$ are selected to be lower than the voltage $V_R$.

With the applied voltages thus selected, when toner is supplied from the toner supply member 5 to the developing roller 46, the electric potential of the developing roller 46 with respect to the toner charges is lower than the electric potential of the toner supply member 45. As a result, the toner can effectively and efficiently be supplied from the toner supply member 45 to the developing roller 46 for thereby eliminating toner supply irregularities.

The selection of the above voltage values is effective in reducing the distribution of the charges of oppositely charged toner and hence in keeping a developed image free of background contamination. As a consequence, a produced image is well developed while reducing toner supply irregularities and background contamination.

The developing roller and the toner supply member, and the developing roller and the toner limiting member are rotated in opposite directions while transferring toner to the developing roller. The inventors conducted an experiment on an image developing device, and found as a result of the experiment that assuming that the peripheral velocity of the developing roller 46 is indicated by $V'_R$, the peripheral velocity of the toner supply member 45 by $V'_{SR}$ and the peripheral velocity of the thin-toner-layer forming member 49 by $V'_{R/R}$ when $$V'_{R/R}/V'_R = 0.03 \text{ to } 0.3$$

the amount M/A of toner attached to the developing roller 46 per unit area was of a desired value ranging from 0.2 mg/cm$^2$ to 0.6 mg/cm$^2$, and also found that when $V'_{R/R}/V'_R$ was constant and $V'_{SP}/V'_R = 0.3$ to 1.0, the toner layer thickness on the developing roller 46 remained unchanged, and the toner layer thickness depended solely on $V'_{R/R}/V'_R$. In the image developing device used in the experiment, when $V'_R$ ranged from 36 mm/s to 1,000 mm/s and $V'_{R/R}/V'_R$ was constant, the toner layer was of a constant thickness for thereby producing a uniform toner layer free of toner supply irregularities.

The thickness of the toner layer on the developing roller 46 and its uniformity vary with the nature of the surface of the thin-toner-layer forming member. Dependent on the material of the thin-toner-layer forming member, the finishing accuracy of the surface of the thin-toner-layer forming member may vary with time even if the finishing accuracy was initially desirably high. For example, the surface of the thin-toner-layer forming member tends to be scratched due to wear, vary in surface roughness because of deterioration of the material of the member, and can be damaged by frictional engagement with a cleaning blade. Therefore, in order to avoid the time-dependent variation of the nature of the surface, it is necessary to increase the hardness of the surface of the thin-toner-layer forming member. This requirement can be met by making the thin-toner-layer forming member up of metal and selecting its surface hardness to be in the range of from 400 to 1,400 according to Vickers hardness test.

Although certain preferred embodiments have been shown and described, it should be understood that many changes and modifications may be made therein without departing from the scope of the appended claims.

What is claimed as new and desired to be secured by Letters Patent of the United States is:

1. An image developing device for electrophotography, comprising:

a housing;

a rotatable drive source disposed in said housing and having an output shaft;

a fixed rotatable member rotatably supported in said housing and fixed with respect to said housing;

a first suspended rotatable member rotatably supported in said housing and reciprocally movable toward and away from said fixed rotatable member in an axially perpendicular direction thereof;

a second suspended rotatable member rotatably supported in said housing and reciprocally movable toward and away from said first suspended rotatable member in an axially perpendicular direction thereof;

a side panel reciprocally movable toward and away from said fixed rotatable member, said side panel supporting said first suspended rotatable member to permit reciprocal movement of said first suspended rotatable member and supporting said second suspended rotatable member to permit reciprocal movement of said second suspended rotatable member in the axially perpendicular direction thereof;

an idler gear driven by said rotatable drive source of said housing at a certain position on said side panel; and rotation transmitting means mounted on said side panel for transmitting a drive output from said idler gear to a driven shaft of said second suspended rotatable member, said rotation transmitting means including coupling means for absorbing axial misalignment between said rotation transmitting means and said driven shaft of said second suspended rotatable member.

* * * * *